US005240182A

United States Patent [19]

Lemme

[11] Patent Number: 5,240,182

[45] Date of Patent: Aug. 31, 1993

[54] ROTARY SPRINKLER NOZZLE FOR ENHANCING CLOSE-IN WATER DISTRIBUTION

[75] Inventor: Charles D. Lemme, Tucson, Ariz.

[73] Assignee: Anthony Manufacturing Corp., Tucson, Ariz.

[21] Appl. No.: 864,449

[22] Filed: Apr. 6, 1992

[51] Int. Cl.[5] ..... B05B 15/10

[52] U.S. Cl. ..... 239/205; 239/206

[58] Field of Search ..... 239/203, 204, 205, 206, 239/239

[56] References Cited

U.S. PATENT DOCUMENTS

| | | | |
|---|---|---|---|
| 3,149,784 | 9/1964 | Skidgel | 239/206 |
| 3,645,451 | 2/1972 | Hauser | 239/206 |
| 3,955,764 | 5/1976 | Phaup | 239/206 |
| 4,681,259 | 7/1987 | Troup et al. | 239/206 |
| 4,840,312 | 6/1989 | Tyler | 239/205 |
| 5,107,717 | 4/1992 | Jackerson | 239/239 |
| 5,141,157 | 8/1992 | Han et al. | 239/206 |

*Primary Examiner*—Andres Kashnikow
*Assistant Examiner*—Lesley D. Morris
*Attorney, Agent, or Firm*—Kelly, Bauersfeld & Lowry

[57] ABSTRACT

An irrigation sprinkler nozzle comprising a tubular nozzle housing with a nozzle body mounted therein, the nozzle body defining a nozzle passageway having an outlet orifice and cooperating with the housing to define a chamber between the body and housing with a chamber outlet passage disposed adjacent the outlet orifice. A water bleed opening is formed to communicate between the passageway up-stream of the outlet orifice and the chamber so that water flowing through the passageway is bled into the chamber and aspirated into the stream from the outlet orifice through the outlet passage.

12 Claims, 1 Drawing Sheet

ROTARY SPRINKLER NOZZLE FOR ENHANCING CLOSE-IN WATER DISTRIBUTION

BACKGROUND OF THE INVENTION

This invention relates to nozzles for rotary irrigation sprinklers, and more particularly to a new and improved nozzle construction for enhancing the close-in distribution of water ejected from such nozzles.

Rotary sprinklers have long been known and used in the irrigation art to apply irrigating water over a circular or part circular area around the sprinkler. Typically, such sprinklers employ single or multiple outlet nozzles though which water is ejected upwardly and radially outwardly from the sprinkler body, and include a means for causing the nozzle to be rotated such as by an impact drive arm assembly mounted to the sprinkler body which interrupts the stream from the nozzle, or by a water operated motor such as a ball drive, gear drive or turbine drive device mounted within a sprinkler casing forming part of the sprinkler body. In many cases, the sprinkler is designed to have a pop-up mechanism wherein the nozzle is attached to the upper end of a tubular riser mounted within the sprinkler casing for extension and retraction so that the nozzle will be extended above the casing when the sprinkler is in operation, and be retracted inside the casing when the sprinkler is not in operation.

The nozzles used with such sprinklers, particularly those of the pop-up type, frequently incorporate one or more nozzle outlets formed as tubular passageways surrounded by a housing coupled to the upper end of the riser, and which are designed to eject generally columnated water streams outwardly around the sprinkler. One example of such sprinkler and nozzle construction is that illustrated in U.S. Pat. No. 4,681,259 entitled Rotary Drive Sprinkler.

The function of the sprinkler nozzle is to convert the pressure energy of the relatively low velocity water entering the sprinkler casing from a supply source into kinetic stream energy. The more effective the conversion of the pressure energy to kinetic stream energy, the greater the distance the stream from the nozzle will travel before falling to the ground, the maximum distance for a given supply pressure being referred to in the art as the maximum range of the nozzle.

With irrigation sprinklers, it is generally recognized that the ideal distribution pattern of precipitation around the sprinkler body is a wedge shaped pattern with the maximum water precipitation rate or "fallout" occurring at the sprinkler body and decreasing progressively to zero radially outwardly away from the sprinkler. For this reason, most sprinklers are designed to be installed in an array with the spacing between adjacent sprinklers being equal to the maximum range of the nozzle employed. To reduce the number of sprinklers required to irrigate a given area, it would be desirable to employ nozzles having the greatest range possible. However, if all of the the incoming water pressure is converted to kinetic stream energy, the water ejected by the nozzle would produce a doughnut-shaped fallout pattern with little fallout occurring near the sprinkler body and relatively large fallout occurring toward the maximum range. Thus, to achieve the ideal precipitation pattern, some compromise in range must be made to achieve the desired fallout pattern close-in to the sprinkler body.

With rotary sprinklers of the impact drive type, this compromise is achieved, at least in large part, as a result of the repeated and cyclical stream interruptions of the drive arm. However, with continuous flow type nozzles such as of the type disclosed in the aforementioned patent, increasing the close in water precipitation pattern must be achieved through other means. One approach has been to use multiple nozzle passages, a relatively large passage for achieving the desired maximum range (typically referred to as a "range nozzle"), and a relatively smaller nozzle passage (typically referred to as a "spreader nozzle") for achieving more close in water fallout. With the multi-nozzle approach, the principal mechanism for achieving fallout at the desired range is that of air friction. That is, the decelerating effects of air friction act on the surface area while inertia is dependant on volume, so the ratio of inertia to friction increases with water droplet diameter. Since large size range nozzles produce relatively high velocity streams of relatively large sized water droplets, the effects of air friction are minimized as compared with the air friction effects on the relatively lower velocity, smaller droplet sized streams from the smaller size spreader nozzles.

In an effort to produce the desired wedge shaped precipitation pattern with multi-nozzle sprinklers, various proposals have been made for varying the geometry and size of the small spreader nozzle to enhance close-in water fallout. Small outlet openings or outlet openings with a large perimeter but a small area tend to produce small droplets that lose their kinetic energy rapidly and fallout close-in to the sprinkler, while larger outlet openings produce larger droplets which project much further. In an effort to achieve the substantial volume of small droplet size water required to achieve the ideal wedge shaped precipitation pattern, it has been necessary to utilize a number of small diameter outlet openings or spreader nozzles to compliment the larger diameter range nozzle. A major problem, however, with this approach is that the smaller the diameter of the outlet nozzle, the greater the risk that the nozzle opening will become clogged with debris such as sand, dirt, silt, and other particulate material frequently found in irrigation water supply systems, and such small size nozzles tend to produce mist-like sprays which are very susceptible to being blown by wind.

Thus, it would be desirable to provide the relatively large amounts of water needed to achieve the high precipitation rates required for close-in watering to produce a more ideal wedge shaped water distribution pattern without requiring the use of small size outlet nozzle openings. As will become more apparent hereinafter, the present invention has achieved this end in a novel yet highly reliable and effective manner.

SUMMARY OF THE INVENTION

The present invention provides a sprinkler nozzle primarily intended for use with a rotary sprinkler such as of the pop-up type, and having a nozzle body defining a nozzle passageway and outlet orifice for projecting a high velocity, large droplet size water stream into the atmosphere, and which includes a generally closed chamber surrounding at least a portion of the nozzle passageway, and a bleed opening formed between the passageway and the chamber. An outlet passage from the chamber is formed adjacent the outlet orifice so that water entering the chamber through the bleed opening can be aspirated out of the chamber by the water stream projected from the outlet orifice. With this construction, the aspirated water will have relatively low kinetic and pressure energy, thereby producing a relatively high precipitation rate fallout close-in to the sprinkler.

The many features and advantages of the present invention will become more apparent from the following detailed description taken in conjunction with the drawings which disclose, by way of example, the principles of the invention.

DETAILED DESCRIPTION OF THE PRESENTLY PREFERRED EMBODIMENT

Figure 1:
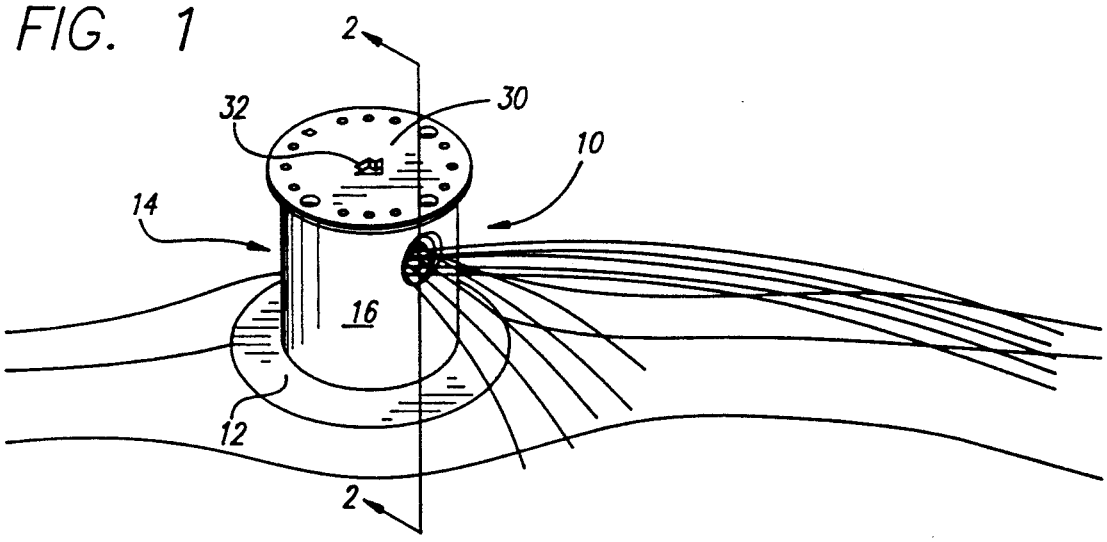
FIG. 1 is a perspective view of a pop-up sprinkler nozzle and housing embodying the principles of the present invention.

As shown in the exemplary drawings, the present invention is embodied in a new and improved sprinkler nozzle construction, generally designated 10, primarily intended for use with rotary pop-up sprinklers of the type incorporating a continuous flow nozzle rotated by a water operated drive motor (not shown), such as of the turbine, gear or ball drive type, encased within a sprinkler casing (the upper end of which is shown in FIG. 1 and designated 12) adapted to be embedded in the ground and coupled to a suitable source of pressurized water (also not shown). In this instance, the sprinkler nozzle 10 can be characterized as being generally of the type illustrated in U.S. Pat. No. 4,681,259 entitled Rotary Drive Sprinkler, the disclosure of which can be reviewed for a more detailed discussion of the overall sprinkler construction, and which is incorporated herein by this reference.

Figure 2:
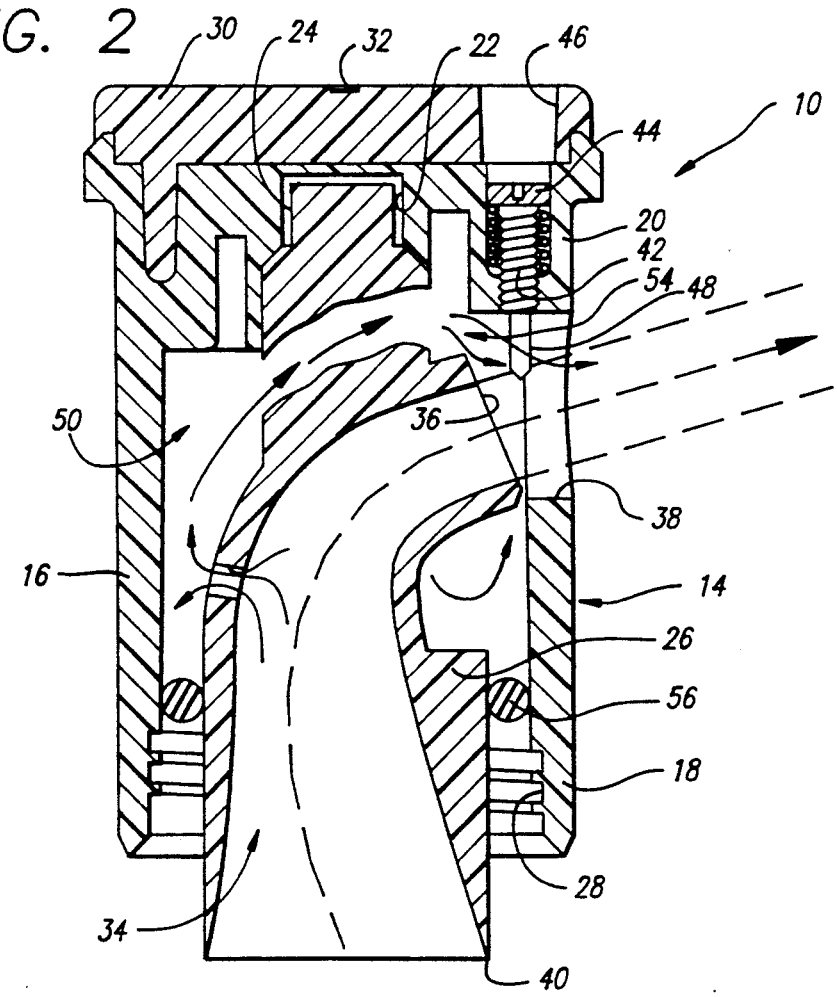
FIG. 2 is an enlarged fragmentary side cross-sectional view of the sprinkler nozzle and housing of FIG. 1, taken substantially along the line 2 2 of FIG. 1.

As best seen in FIG. 2, the sprinkler nozzle 10 herein comprises a downwardly open cylindrical housing 14, preferably made of molded plastic, formed by a cylindrical sidewall 16 having a lower end portion 18 and a closed upper end portion 20, and defining an interior generally cylindrical shaped cavity. Formed centrally in the upper end portion 20 of the nozzle housing 14 is a keyway 22 adapted for seated reception of a key 24 formed as an upwardly projecting base at the upper end of a nozzle body 26, the nozzle body preferably being formed of molded plastic and constructed as two longitudinally divided and mating mirror image halves coupled together. The nozzle housing 14 is adapted to be mounted to the upper end of a tubular riser (not shown) formed as part of the overall sprinkler, and is provided with interior annular threads 28 disposed about the lower end portion 18 of the sidewall 16 for this purpose. Herein, overlying the upper end of the nozzle housing 14 is a disc-shaped cover 30 which, as seen in FIG. 1, is provided with an embossed arrow 32 to indicate the direction in which water from the sprinkler nozzle 10 will be projected.

The coupled nozzle halves defining the nozzle body 26 cooperatively define an elongated internal converging water flow path or passageway 34 which extends from below the lower end of the nozzle housing 14 upwardly within the nozzle housing cavity, and then turns laterally to terminate in a nozzle outlet orifice 36 which is upwardly inclined with respect to the horizontal, typically at an angle between approximately twenty and thirty degrees. The mated reception of the nozzle body key 24 within the keyway 22 of the nozzle housing 14 acts to hold the nozzle body 26 in position within the housing, and orients the nozzle body so that the nozzle outlet orifice 36 is aligned with a generally circular outlet opening 38 formed through the sidewall 16 of the housing. It should be noted that the lower end of the nozzle body 26 is adapted to be mated with the upper end of the tubular riser (not shown) within the sprinkler casing 12, such as is disclosed in the aforementioned patent, so that water from the supply source will be directed through the passageway 34 during sprinkler operation.

The passageway 34 and outlet orifice 36 function to define a relatively large bore range nozzle portion of the sprinkler nozzle 10, and ejects a relatively high velocity, large droplet size water stream outwardly into the atmosphere through the outlet opening 38 of the nozzle housing 14. In this instance, to break up a portion of the high velocity stream ejected from the outlet orifice 36 so that a more uniform precipitation pattern is produced, an adjustable breakup pin 42 of conventional design is threadably mounted through the closed upper end portion 20 of the nozzle housing 14, the breakup pin having a slotted head 44 accessible through an opening 46 in the cover for adjusting the position of a downwardly extending pointed shaft 48 which projects into the stream from the outlet orifice.

In accordance with the present invention, in addition to the nozzle outlet orifice 36 forming the range nozzle portion of the sprinkler nozzle 10, the nozzle housing 14 is formed to cooperate with the nozzle body 26 in a highly reliable and effective manner to produce a low velocity spray for enhancing the water precipitation rate pattern close-in to the sprinkler nozzle, thereby to produce an overall precipitation rate pattern which more closely approximates the ideal wedge shaped pattern than that achieved with most prior sprinkler nozzles such as of the general type disclosed in the aforementioned patent. Moreover, the sprinkler nozzle 10 of the present invention accomplishes this result without requiring relatively small size openings, and does so in a relatively simple and inexpensive manner to produce a spray that will minimize the effects of wind.

Toward the foregoing ends, the nozzle body 26 and nozzle housing 14 cooperate to form a relatively large, generally closed annular chamber 50 between the exterior of the nozzle body and the interior of the nozzle housing, and a bleed hole 52 is formed through the nozzle body for communicating between the nozzle passageway 34 and the chamber to allow a portion of the water flowing through the passageway to bleed into the chamber. Notably, the bleed hole 52, herein a hole of circular cross-section, is formed through the nozzle body 26 well up-stream of the outlet orifice 38 at a location where the water flowing through the passageway 34 still has significant pressure energy that has not been converted to kinetic energy in the converging passageway. As shown in FIG. 2, the bleed hole 52 is formed through the nozzle body 26 to direct a portion of the pressurized water flowing through the passageway 34 is rearwardly in a direction substantially opposite the direction of water flow through the outlet orifice 38. Moreover, the bleed hole 52 is formed to has a relatively large cross-sectional size as compared with the typical size of the small diameter outlet nozzles or openings used to form conventional spreader nozzles, thereby to minimize the possibility of the bleed hole becoming blocked or clogged with debris during use.

The annular chamber 50 herein is formed to extend fully around the nozzle body 26 and beyond the upwardly inclined end of the outlet orifice 36 to the outlet opening 38. This results in a relatively large sized gap 54 being formed between the end of the outlet orifice 36 and chamber 50, and which acts as an outlet passage from the chamber through which water can flow. Notably, the outlet opening 38 through the nozzle housing 14 is formed to have a substantially larger cross-sectional opening size than the cross-sectional size of the outlet orifice 36 so that the outlet opening does not interfere with the stream ejected by the outlet orifice. Herein, an o-ring type seal 56 is compressed between the nozzle body 26 below the bleed hole 52 and the inside of the nozzle housing sidewall 16 above the threads 28 to provide a water tight seal at the bottom of the annular chamber 50 so that the chamber is effectively closed except for the outlet passage defined by the gap 54.

With the foregoing construction, when the sprinkler nozzle 10 is in operation, a portion of the water flowing through the passageway 34 will be bled through the bleed hole 52 into the annular chamber 50 and fill the space. Since the size of the annular chamber 50 is relatively large, the velocity of the water entering the chamber will be substantially dissipated. As the annular chamber 50 becomes filled with bleed water, the relatively high velocity of the stream ejected from the outlet orifice 36 will pull water from the chamber through the gap 54 into the high velocity stream which will then carry that water outwardly through the outlet opening 38 and away from the sprinkler nozzle 10. Thus, the high velocity stream from the outlet orifice 36 effectively aspirates water from the chamber 50 and transfers a small portion of its kinetic energy to the aspirated water to cause the same to be accelerated out of the outlet opening 38. However, since the energy transfer from the high velocity stream ejected from the outlet orifice 36 to the aspirated water from the chamber 50 is extremely inefficient, the aspirated water remains as a water spray having relatively low kinetic energy, and thus, will fall out relatively quickly after leaving the sprinkler nozzle 10. Moreover, since the water aspirated from the chamber 50 has relatively little pressure energy, the resultant spray is composed of relatively large size droplets which will not tend to be significantly effected by wind.

It should be appreciated that by selecting the relative size of the bleed hole 52, the amount of water bled from the stream flowing through the passageway 34 of the nozzle body 26 can be controlled so that the amount of water available to be aspirated out of the sprinkler nozzle 10 for close-in watering can also be controlled. Thus, the precipitation rate achieved by the aspiration of bleed water from the annular chamber 50 can be selected to complement the precipitation rate and range of the water ejected through the outlet orifice 36 to achieve a total precipitation rate pattern that more closely approximates the ideal wedge shaped pattern.

In tests conducted using a Model R-70 sprinkler manufactured by Rain Bird Sprinkler Mfg. Corp. of Glendora, Calif., having a No. 18 standard sprinkler nozzle constructed as disclosed in the aforementioned patent, it was found that by modifying that nozzle to incorporate a 0.116 inch diameter bleed hole in the nozzle body so that water was bled into the existing annular chamber between the nozzle body and the inside of the nozzle housing, when the sprinkler was operated at a supply pressure of 60 pounds per square inch, a five percent increase in the coefficient of uniformity was achieved with a total precipitation rate pattern that more closely approximated the ideal wedge shaped pattern than that of the corresponding standard nozzle without the present invention. Although a slight reduction in maximum range (approximately two feet) was also noted, a substantial increase in precipitation rate (approximately one gallon per hour) near the sprinkler was observed, that increase having a significant effect on the enhanced overall precipitation rate pattern.

From the foregoing, it should be appreciated that the present invention provides a new and improved sprinkler nozzle 10 for enhancing the precipitation rate pattern of a rotary irrigation sprinkler which is relatively simple in design, reliable and effective in use, and inexpensive to manufacture. While a particular form of the invention has been illustrated and described herein, it will also be apparent that various modifications and changes can be made without departing from the principles of the invention as set forth in the following claims.

I claim:

1. In an irrigation sprinkler nozzle of the type including a nozzle body having an elongated nozzle passageway formed therein, the passageway having an inlet end adapted to receive pressurized water from a supply source and an outlet orifice through the passageway is ejected outwardly into the atmosphere away from the nozzle body as a relatively high velocity stream composed of relatively large size droplets, the improvement comprising:

means for defining a relatively large, generally closed chamber around at least a portion of said nozzle passageway, said chamber having an outlet passage adjacent said outlet orifice for communication therewith; and a bleed opening between said nozzle passageway and said chamber located up-stream of said outlet orifice and through which a portion of the pressurized water flowing through said passageway can be passed into said chamber, said chamber having a size sufficiently large to substantially dissipate the velocity energy of water flowing through said bleed opening, whereby the velocity of the water bled from said passageway through said bleed opening into said chamber is dissipated and fills said chamber to be aspirated out of said chamber through said chamber outlet passage as a stream of relatively low kinetic energy by said relatively high velocity stream ejected from said outlet orifice.

2. The improvement as set forth in claim 1 wherein said means includes a nozzle housing surrounding the nozzle body and cooperatively defining therewith an annular chamber, said outlet passage being defined by a gap between said nozzle housing and said nozzle body adjacent the outlet orifice.

3. The improvement as set forth in claim 2 wherein said bleed opening has a generally circular cross-section opening in a direction opposite that of said outlet orifice.

4. The improvement as set forth in claim 3 wherein said nozzle body and said nozzle housing are formed of molded plastic.

5. An irrigation sprinkler nozzle primarily intended for use with a rotary drive sprinkler adapted to be coupled with a source of pressurized water, said nozzle comprising:

a generally tubular shaped nozzle housing;

a nozzle body formed within said housing and having a nozzle passageway formed therein, said passageway having an inlet end adapted to receive pressurized water from a source, and an outlet end defining an outlet orifice through which a high velocity, large droplet size water stream can be ejected;

a relatively large chamber defined by a generally closed space formed between said nozzle body and said nozzle housing around at least a portion of said passageway, said chamber having an outlet passage formed adjacent said outlet orifice; and a bleed hole formed in said nozzle body for communicating between said passageway and said chamber, said bleed hole being disposed between said inlet end and said outlet end, said chamber having a size sufficiently large to substantially dissipate the velocity energy of water flowing through said bleed opening, whereby a portion of the pressurized water flowing through said passageway can bleed into said chamber through said bleed hole to fill said chamber and be aspirated from said chamber through said outlet passage as a water spray having relatively low kinetic energy by the stream from said outlet orifice.

6. An irrigation sprinkler nozzle as set forth in claim 5 wherein said outlet passage is defined by a gap between said nozzle housing and said outlet orifice.

7. An irrigation sprinkler nozzle as set forth in claim 6 wherein said bleed opening has a substantially smaller size than the size of said chamber and said gap is substantially larger in size than said bleed opening.

8. An irrigation sprinkler nozzle as set forth in claim 7 wherein said nozzle housing and said nozzle body are formed as separate members, said nozzle body being mounted within said nozzle housing.

9. An irrigation sprinkler nozzle as set forth in claim 8 wherein said nozzle body and said nozzle housing are each formed by molded plastic.

10. An irrigation sprinkler nozzle as set forth in claim 9 wherein said nozzle housing includes a generally cylindrical sidewall having an outlet opening formed therethrough, said nozzle body being mounted within said housing with said outlet orifice aligned with said outlet opening.

11. An irrigation sprinkler nozzle as set forth in claim 10 wherein said outlet opening is larger in size than the size of said outlet orifice.

12. An irrigation sprinkler nozzle as set forth in claim 11 wherein said gap defining said outlet passage is formed as a space between said cylindrical sidewall and said outlet orifice.

* * * * *